US005788082A

United States Patent [19]

Nyseth

[11] Patent Number: 5,788,082

[45] Date of Patent: Aug. 4, 1998

[54] WAFER CARRIER

[75] Inventor: David L. Nyseth, Plymouth, Minn.

[73] Assignee: Fluoroware, Inc., Chaska, Minn.

[21] Appl. No.: 678,886

[22] Filed: Jul. 12, 1996

[51] Int. Cl.[6] ..... B65D 85/48

[52] U.S. Cl. ..... 206/711; 206/454; 206/710

[58] Field of Search ..... 206/454, 701, 206/710, 711; 118/500, 728

[56] References Cited

U.S. PATENT DOCUMENTS

| | | | |
|---|---|---|---|
| 4,534,389 | 8/1985 | Tullis . | |
| 4,674,939 | 6/1987 | Maney et al. . | |
| 4,676,008 | 6/1987 | Armstrong | 206/454 |
| 4,739,882 | 4/1988 | Parikh et al. . | |
| 4,779,732 | 10/1988 | Boehm et al. | 206/711 |
| 4,815,912 | 3/1989 | Maney et al. . | |
| 4,872,554 | 10/1989 | Quernemoen | 206/454 |
| 5,054,418 | 10/1991 | Thompson et al. | 206/454 |
| 5,253,755 | 10/1993 | Maenke | 206/711 |
| 5,255,797 | 10/1993 | Kos | 206/711 |
| 5,476,176 | 12/1995 | Gregerson et al. | 206/711 |
| 5,534,074 | 7/1996 | Koons | 206/454 |

FOREIGN PATENT DOCUMENTS

| | | |
|---|---|---|
| WO 90/14273 | 11/1990 | WIPO . |
| WO 96/09787 | 4/1996 | WIPO . |

*Primary Examiner*—David T. Fidei
*Attorney, Agent, or Firm*—Palmatier, Sjoquist, Voigt & Christensen, P.A.

[57] ABSTRACT

A wafer container for transporting or holding wafers in a horizontal axially aligned arrangement has minimal four point regions of wafer support at the edge portion of the wafers. A preferred embodiment has a first container portion and a closeable door. The first container portion has a first molded portion of a static dissipative material having an upright door frame with integral planar top portion. An integral bottom base portion with an equipment interface also extends from the door frame. A second molded portion has a transparent shell which connects to the door frame, to the planar top portion, and to the bottom base portion. Separately molded wafer support columns connect to the top planar portion and to the bottom base portion and include vertically arranged shelves with upwardly facing projection providing minimal point or point region contact with the wafers. The shelves include wafer stops to interfere with forward or rearward movement of the wafers when supported by the projections and to prevent insertion beyond a seating position. A side handle engaging both the first molded portion and the second molded portion operates to secure the molded portions together. A robotic handle connects to the planar top portion. The robotic handle, the wafer shelves, the side handles, and the door frame have a conductive path to ground through the machine interface.

31 Claims, 14 Drawing Sheets

WAFER CARRIER

BACKGROUND OF THE INVENTION

This invention relates to semiconductor processing equipment. More specifically it relates to carriers for transporting and storing semiconductor wafers.

As semiconductors have become larger in scale, that is, as the number of circuits per unit area has increased, particulates have become more of an issue. The size of particulates that can destroy a circuit has decreased and is approaching the molecular level. Particulate control is necessary during all phases of manufacturing, processing, transporting, and storage of semiconductor wafers. Particle generation during insertion and removal of wafers into carriers and from movement of wafers in carriers during transport needs is to be minimized or avoided.

Build-up and discharge of static charges in the vicinity of semiconductor wafers can be catastrophic. Static dissipation capability is a highly desirable characteristic for wafer carriers. Static charges may be dissipated by a path to ground through the carrier. Any parts that are contacted by equipment or that may contact wafers or that may be touched by operating personnel would benefit by a path to ground. Such parts of carriers would include the wafer supports, robotic handles, and equipment interfaces.

Visibility of wafers within closed containers is highly desirable and may be required by end users. Transparent plastics suitable for such containers, such as polycarbonates, are desirable in that such plastic is low in cost but such plastics do not have adequate static dissipative characteristics nor desirable abrasion resistance.

Materials for wafer carriers also need to be rigid to prevent damage to wafers during transport and also need to be dimensionally stable through varying conditions.

Conventional ideal carrier materials with low particle generation characteristics, dimensional stability, and other desirable physical characteristics, such as polyetheretherketone (PEEK), are not transparent, are relatively expensive, and are difficult to mold into unitary large and complex shapes such as carriers and containers.

Generally containers and carriers for storing and transporting wafers have been designed to transport and hold wafers in vertical planes. Such carriers are typically configured for also allowing a carrier position with the wafers in a horizontal position for processing and/or insertion and removal of the wafers. In the horizontal position the wafers are conventionally supported by ribs that form the wafer slots and extend along the length of the interior sides of the carrier. The carrier side is partially curved to follow the wafer edge contour. Such carriers contact and support the wafers along two arcs on or adjacent to the wafer edge. This type of support is not conducive to uniform, consistent, and positive wafer location relative to the wafer carriers and relative to associated equipment.

Additionally the shift of conventional carriers from the vertical transport position to the horizontal insertion-removal-process position can cause wafer rattle, wafer shifting, wafer instability, particle generation and wafer damage.

The industry is evolving into processing progressively larger wafers, i.e., 300 mm in diameter, and consequently larger carriers and containers for holding wafers are needed. Moreover the industry is moving toward horizontal wafer arrangements in carriers and containers. Increasing the size of the carriers has exacerbated shrinkage and warpage difficulties during molding. Increased dependence upon robotics, particularly in the removal and insertion of wafers into carriers and containers, has made tolerances all the more critical. What is needed is an optimally inexpensive, low particle generating, static dissipative carrier in which the wafers are stable, consistently and positively positioned and are visible when enclosed.

SUMMARY OF THE INVENTION

A wafer container for transporting or holding wafers in a horizontal axially aligned arrangement has minimal four point regions of wafer support at the edge portion of the wafers. A preferred embodiment has a first container portion and a closeable door. The first container portion has a first molded portion of a static dissipative material having an upright door frame with integral planar top portion. An integral bottom base portion with an equipment interface also extends from the door frame. A second molded portion has a transparent shell which connects to the door frame, to the planar top portion, and to the bottom base portion. Separately molded wafer support columns connect to the top planar portion and to the bottom base portion and include vertically arranged shelves with upwardly facing projection providing minimal point or point region contact with the wafers. The shelves include wafer stops to interfere with forward or rearward movement of the wafers when supported by the projections and to prevent insertion beyond a seating position. A side handle engaging both the first molded portion and the second molded portion operates to secure the molded portions together. A robotic handle connects to the planar top portion. The robotic handle, the wafer shelves, the side handles, and the door frame have a conductive path to ground through the machine interface.

A feature and advantage of the invention is that wafer support is provided with minimal and secure wafer contact by the carrier.

A further advantage and feature of the invention is that the composite design allows optimal use of materials, such as the more expensive abrasion resistant and static dissipative materials, for example PEEK, for the portions of the container that contact the wafers or equipment, and the use of less expensive clear plastic, such as polycarbonate, for the structural support of the container and the viewability of the wafers in the container. Thus, molding parameters and material selection may be chosen for each separately molded part to optimize performance and minimize cost.

A further advantage and feature of the invention is that the composite construction minimizes the negative effects associated with molding large carriers such as warpage and shrinkage.

A further advantage and feature of the invention is that all critical parts may be conductively connected to ground through the equipment interface portion of the carrier.

A further advantage and feature of the invention is that wafers are passively held in a specific seating position by the suitably shaped shelves.

A further advantage and feature of the invention is that the composite container may be assembled and finally secured together using the lugs, tongues, and tabs associated with the side handle.

A further advantage and feature of the invention is that wafer guides are provided that are separate from the wafer support shelves whereby the guides provide easy visual assurance that the container and/or insertion equipment is properly positioned before near full insertion and before the wafer comes into contact with the wafer support shelves and support beads. This can facilitate alignment in that the wafer does not have to be fully inserted to check the rough alignment.

A further feature and advantage of the invention is that the elongate beads facilitate easy molding. A nub requires additional machining after molding or requires more complicated and expensive molds.

A further feature and advantage of a preferred embodiment of the invention is that four point contact minimizes rocking of the individual wafers and provides for greater variations in molding while still maintaining consistent and positive wafer positioning.

A further feature and advantage of the invention is that the door frame with rearwardly extending top and rearwardly extending base portions joined to a U-shaped transparent shell provides a structurally strong carrier with approximately 270° of visibility around the wafers and a conductive path ground.

DETAILED SPECIFICATION

Figure 1:
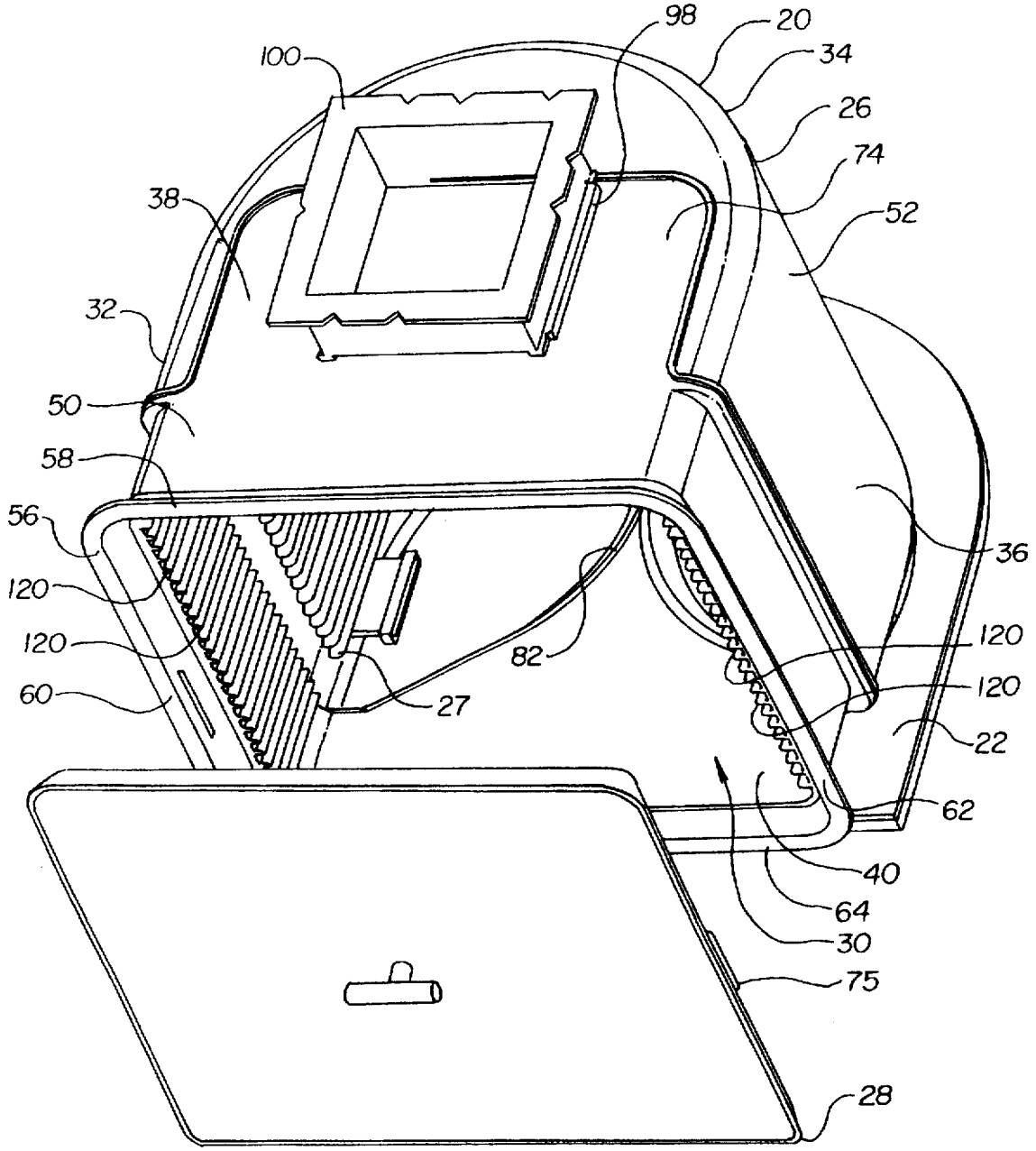
FIG. 1 is a partially exploded perspective view of a composite wafer container having a latchable door.

Referring to FIG. 1 a perspective view of a preferred embodiment of the horizontal wafer carrier in place on equipment 22. FIGS. 2, 3, 4, and 5 show additional embodiments. The wafer carriers are generally comprised of a container portion 26, including wafer support columns 27, and a cooperating door 28. The container portion 26 has a open front 30, a left side 32, a back side 34, a right side 36, a top 38, and a bottom 40. The embodiments of FIGS. 1, 2, 3, and 4 have closed back sides and closed left and right sides. The embodiment of FIG. 5 is a generally open carrier with an open back and with the top and bottom connected by and supported by the wafer support columns.

Figure 2:
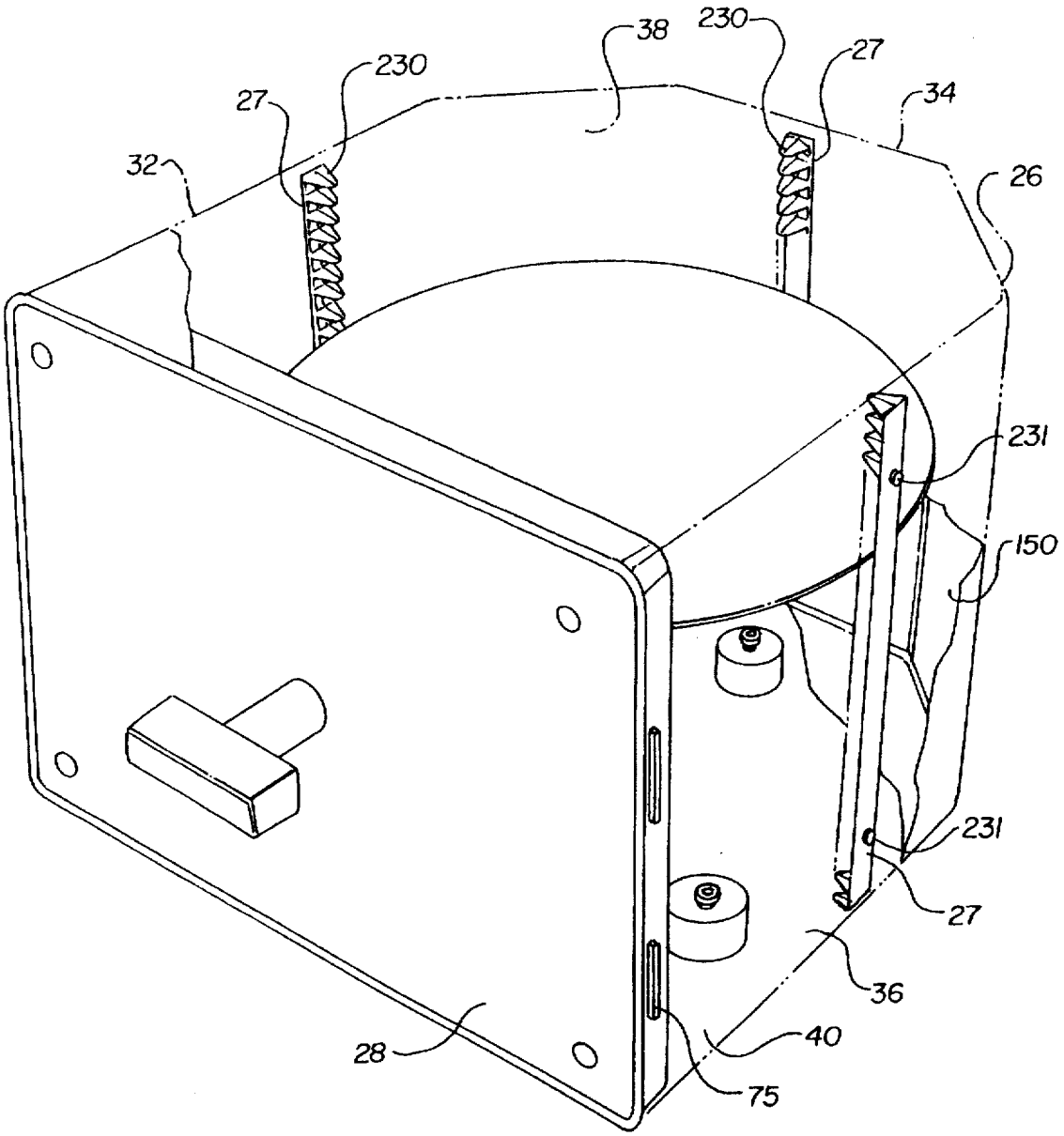
FIG. 2 is a front perspective view of a wafer container with three wafer support columns attached to a U-shaped transparent shell.
Figure 3:
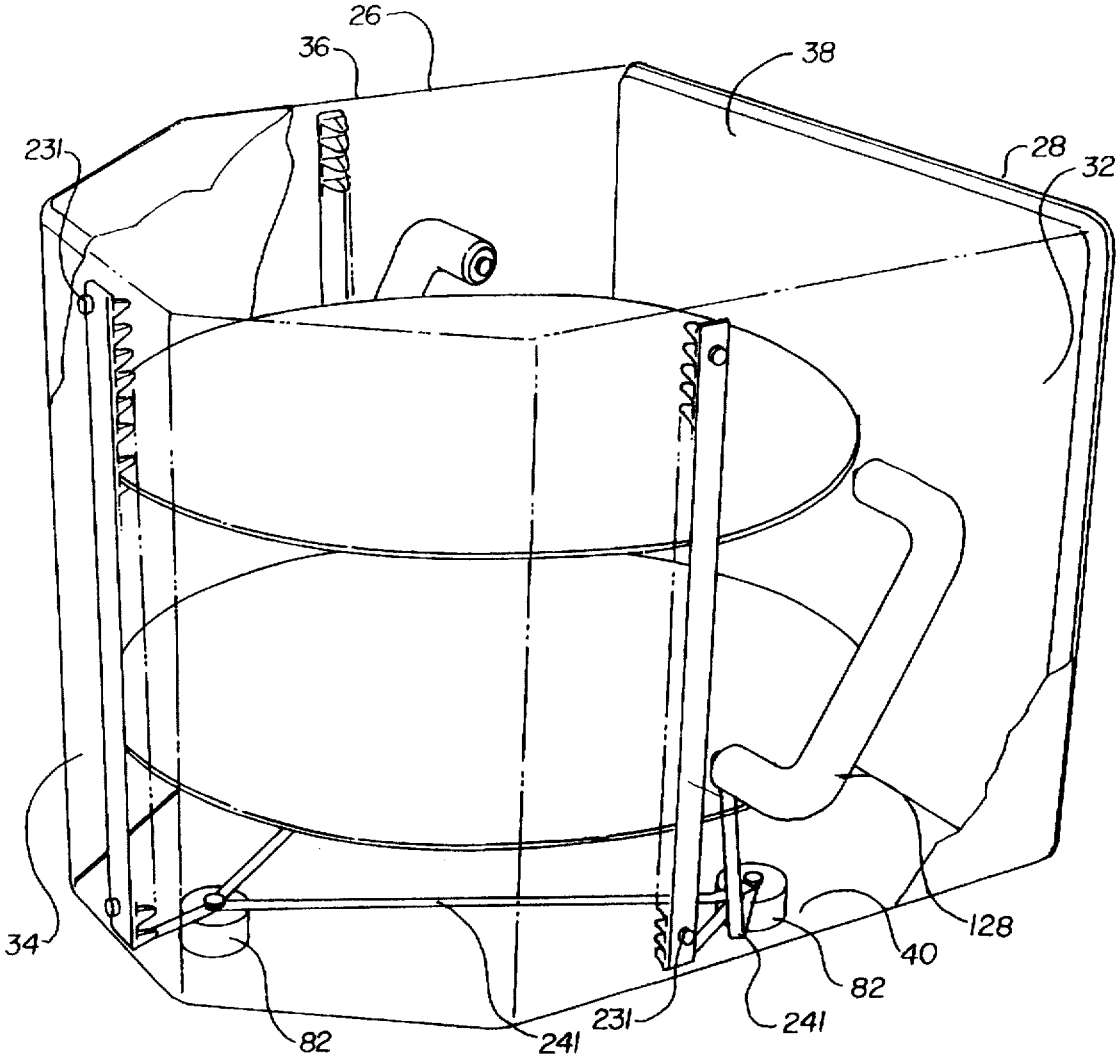
FIG. 3 is a rear perspective view of a carrier similar to that of FIG. 2, with plastic jumpers to provide a path to ground through the equipment interface.
Figure 4:
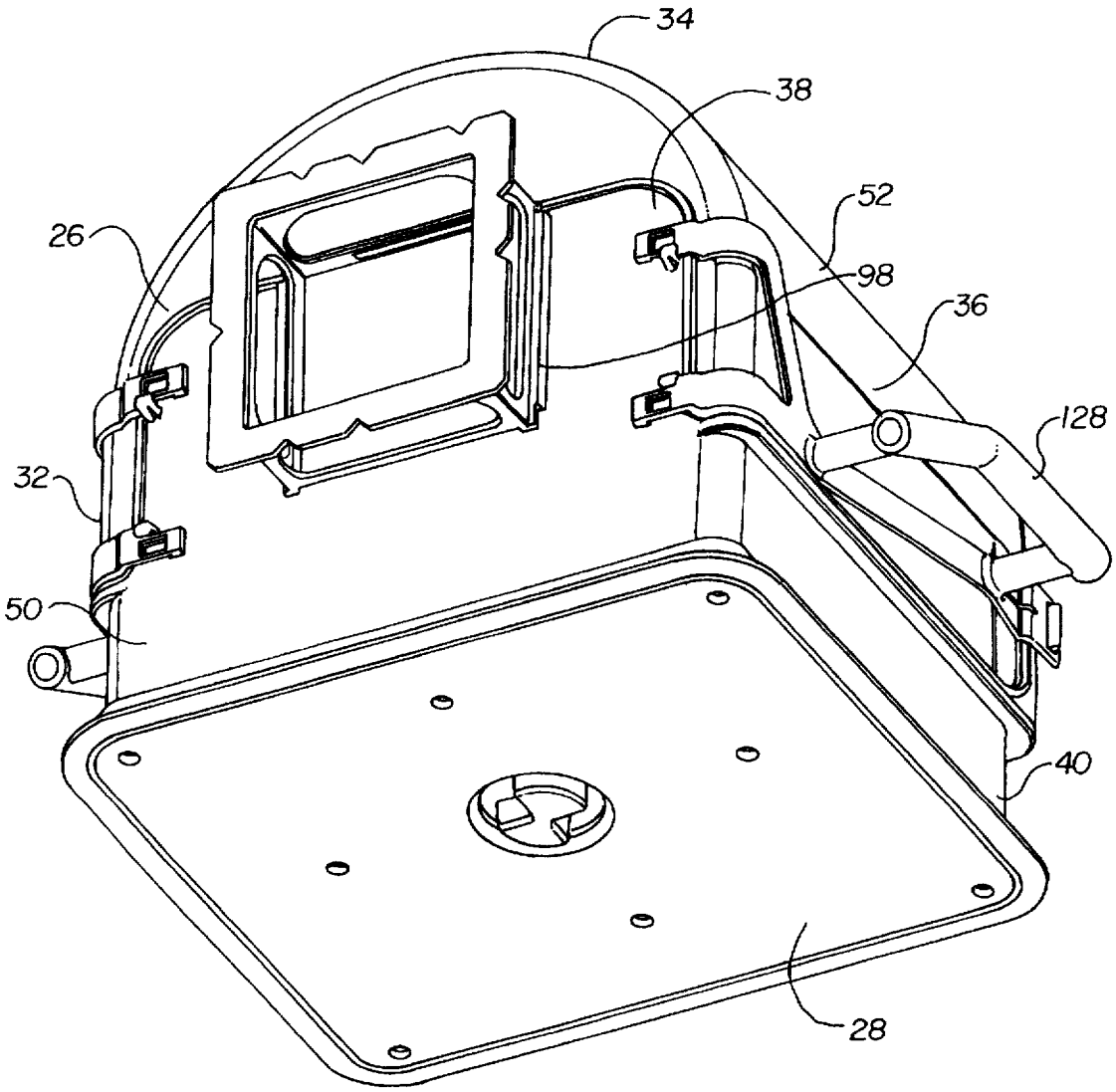
FIG. 4 is a front perspective view of a composite container with side handles, a robotic flange, and a latched door.
Figure 5:
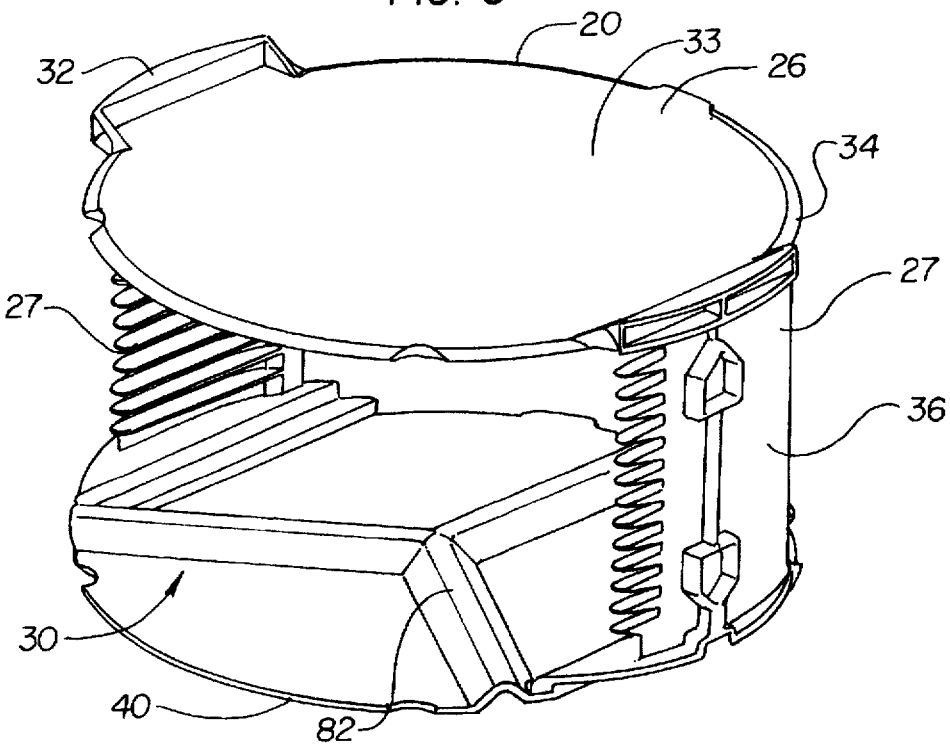
FIG. 5 is a front perspective view of an open wafer carrier according to the invention.
Figure 6:
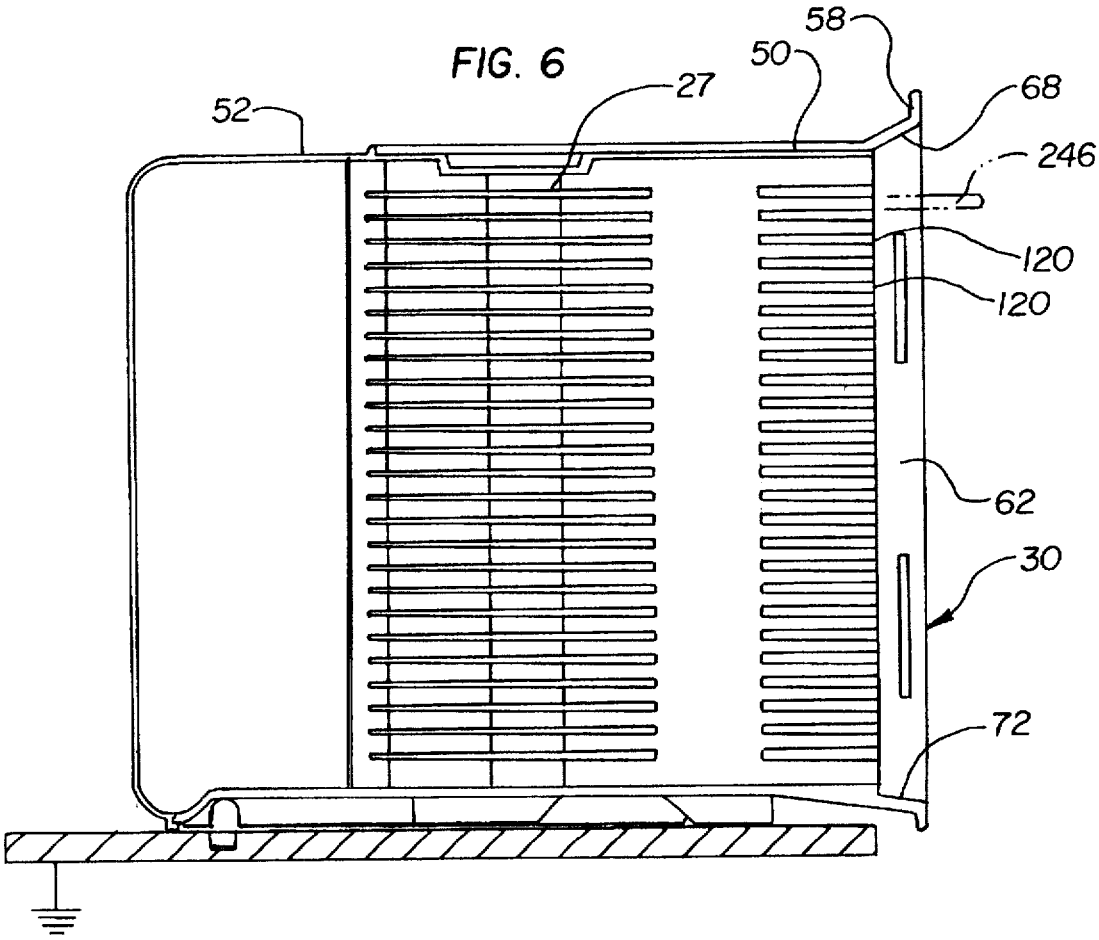
FIG. 6 is a cross-sectional side elevational view of a carrier.
Figure 7:
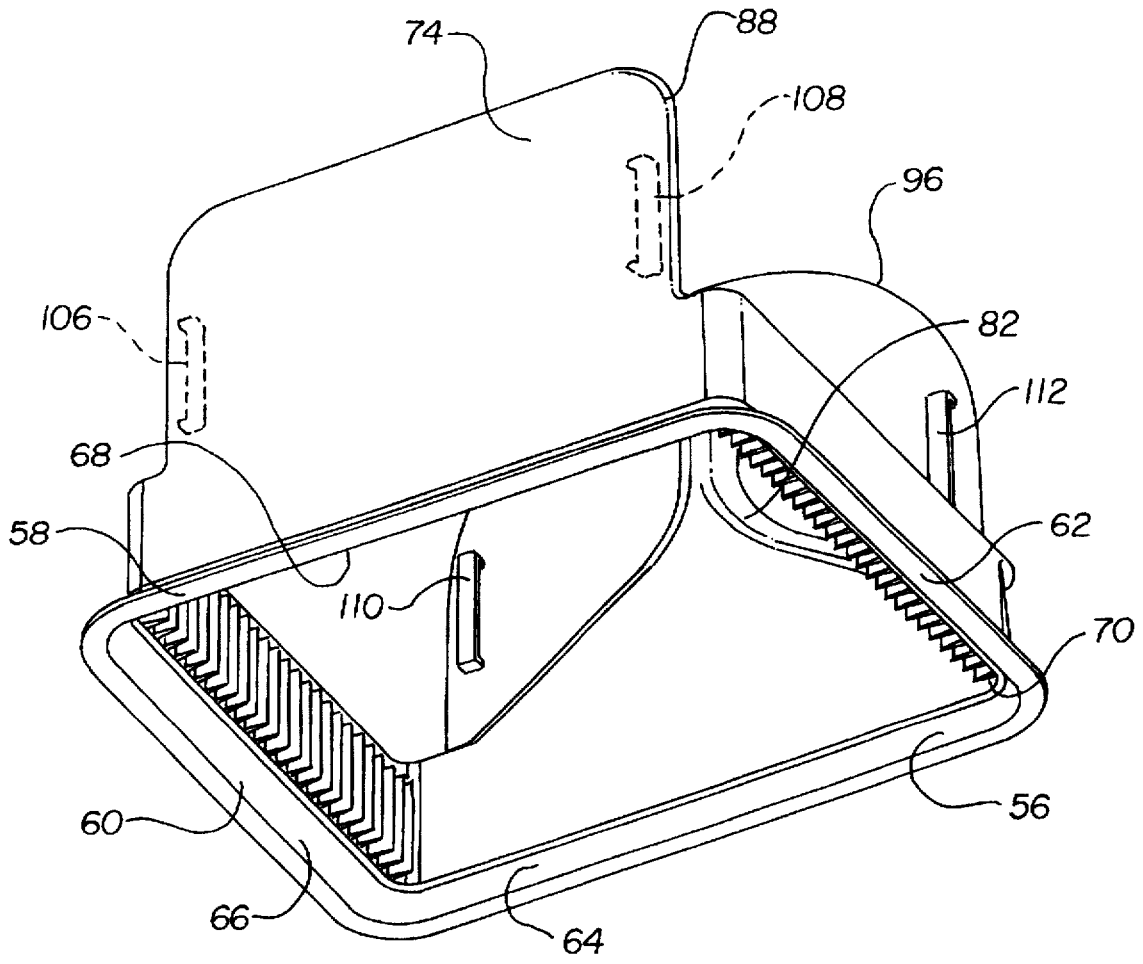
FIG. 7 is a front perspective view of one embodiment of the first molded portion of a wafer carrier.
Figure 8:
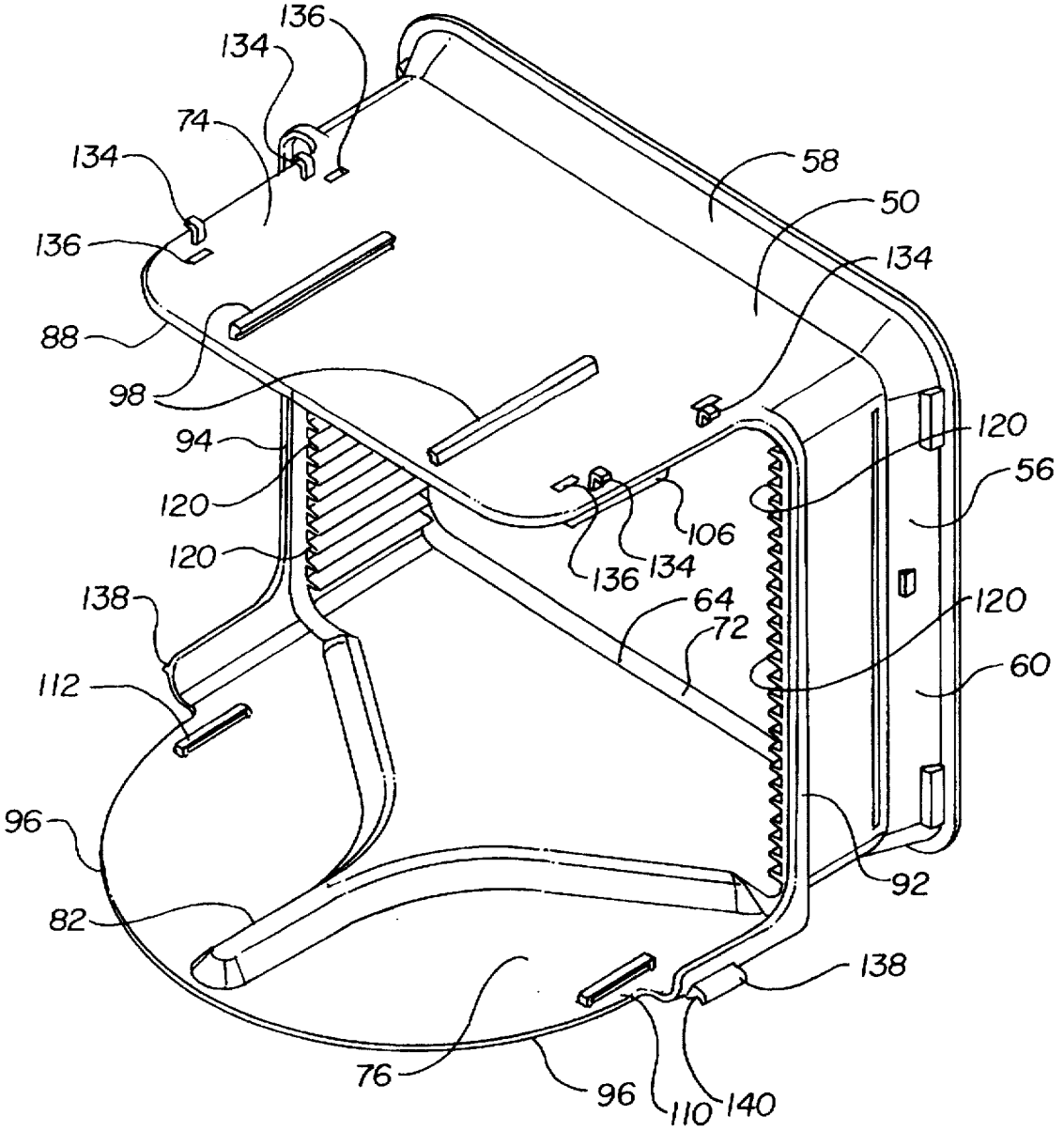
FIG. 8 is a rear perspective view of a first molded portion of one embodiment of the wafer carrier.

Referring specifically to FIGS. 1, 4, and 6 the embodiments shown therein, container portion 26 may be molded of a first molded portion 50 and a second molded portion 52. As shown in FIGS. 1 and 4, or may be molded of a single unitary molded portion as shown in FIGS. 2 and 3. The first molded portion 50, which is shown in isolation in FIGS. 7 and 8, is comprised of a rectangular door frame 56 with a horizontal top frame portion 58, a pair of upright vertical frame portions 60, 62 and a horizontal lower frame portion 64.

The upper frame portion 58 and the vertical frame portion 60, 62 have angled surfaces 66, 68, 70 for receiving and guiding the door during closing. The lower frame portion 64 has a substantially horizontal surface 72 best shown in FIG. 6. The door frame 56 by way of the angled surfaces 66, 68, 70 and the horizontal surface 72 receive the door 28 to close the open front 30. The door frame surfaces may have apertures or recesses 73 to receive tongues 75 which are retractably extendable from the door 28. Extending rearwardly from the upper frame portion 58 is a substantially horizontal top section 74. Extending rearwardly from the lower frame portion 64 is a lower base portion 76 having an equipment interface 82 which is shown configured as a kinematic coupling. A horizontal top section 74 has a horizontal edge portion 88 and the vertical frame portions 60, 62 have vertical edge portions 92, 94. Similarly, the lower base portion 76 has a lower horizontal edge portion 96. The horizontal top section 74 may include engagement flanges 98 for attachment of a handle or robotic flange 100. As shown in FIG. 7, the horizontal top section 74 has a pair of slotted members 106, 108 which correspond to the slotted members 110, 112 positioned on the lower base portion 76. Said slotted members are sized and configured to receive the wafer support columns 27. Extending from the vertical frame portions 60, 62 are a plurality of elongate wafer guides 120. As best shown in FIGS. 4 and 8 additional features may be added to the first molded portion 50 to facilitate connection with the second molded portion 52 and to facilitate the addition of side handles 128. Extending from the horizontal top section 74 are hooked lugs 134 and inset into said top section 74 are recesses 136. Attached to the lower base portion 76 are tabs 138 having a recess 140.

Figure 9:
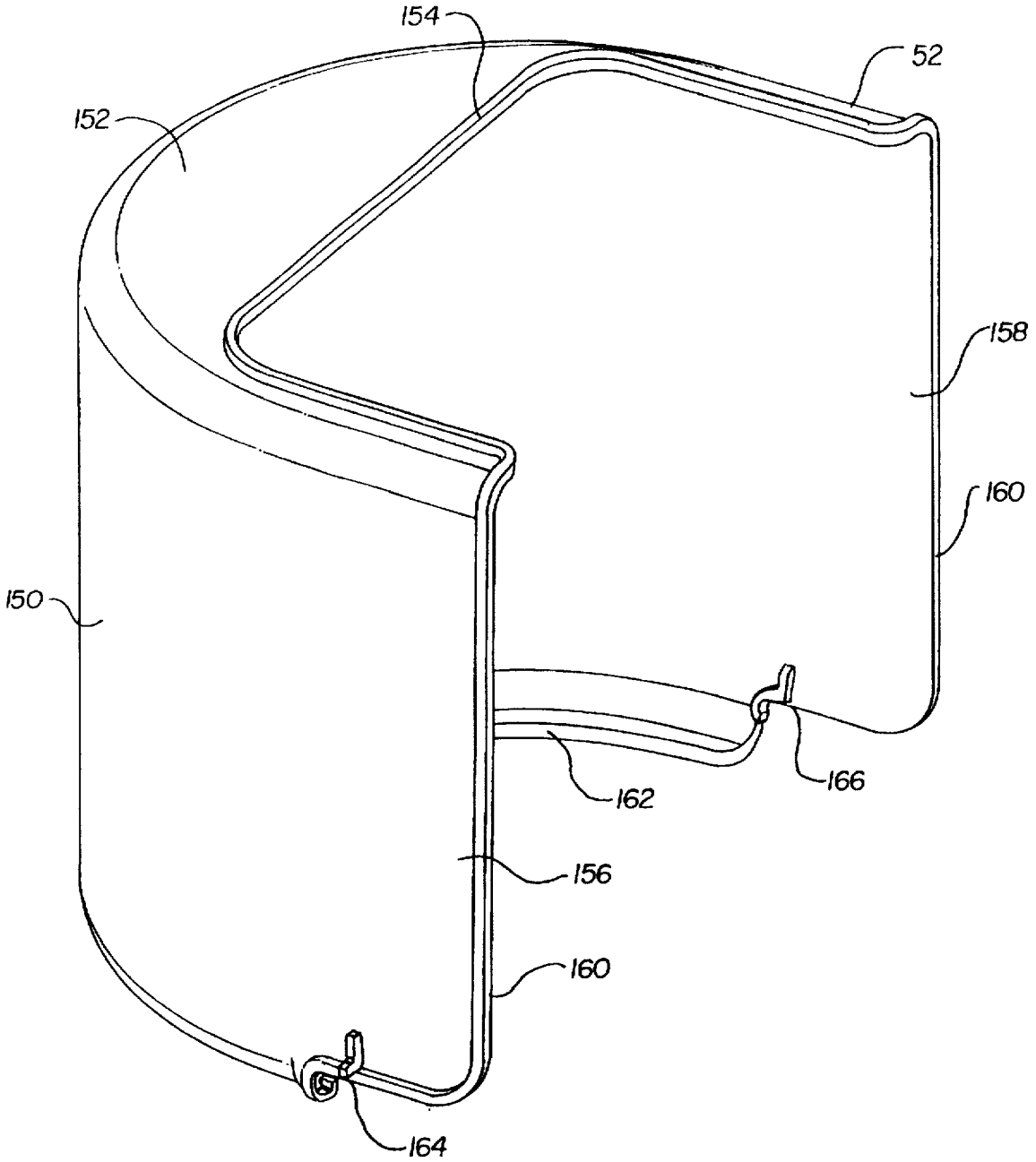
FIG. 9 is a front perspective view of the shell or second molded portion of one embodiment of the wafer carrier.

Referring to FIG. 9 the second molded portion 52 configured as a transparent plastic shell with a gently U-shaped curved panel 150, an upper top panel portion 152, an upper edge portion 154 configured as a splayed lip, vertical side panels 156, 158 also having splayed lip portions 160, a lower horizontal splayed lip 162 and a pair of outwardly extending side rejections 164, 166.

Figure 11:
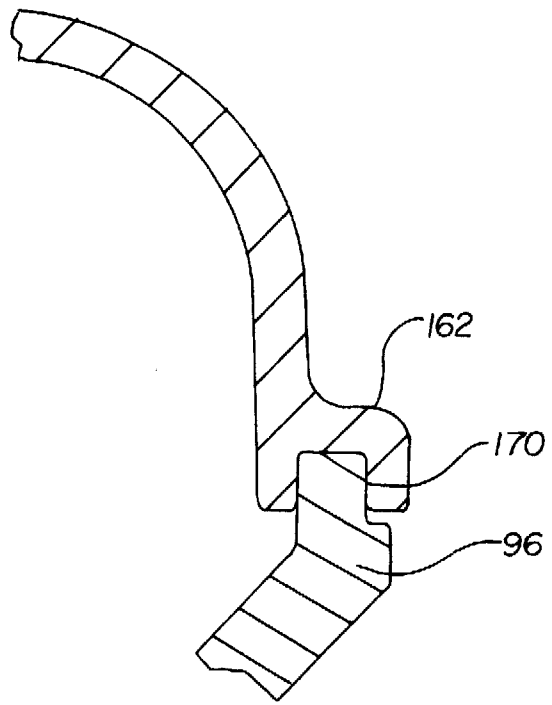
FIG. 11 is a detail cross-sectional view of a connection between the first molded portion and the second molded portion.

Referring to FIG. 11 a splayed lip 162 is shown in detail connecting to an edge portion 96 of the first molded portion 50. The joint is configured as a tongue in groove connection 170.

Figure 10:
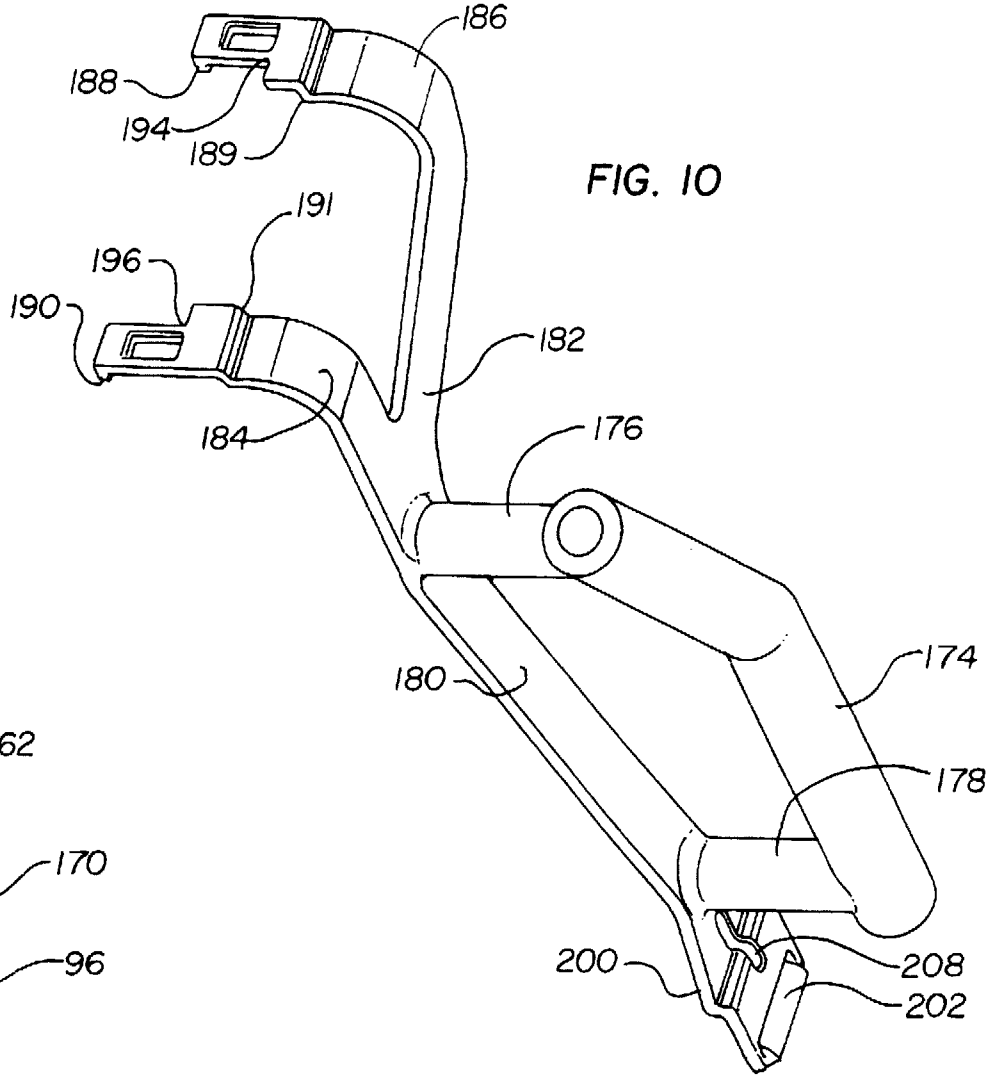
FIG. 10 is a perspective view of a side handle for a composite carrier.

Referring to FIG. 10 a perspective piece part figure of a right handle 128 is portrayed. The side handle has a gripping portion 174 connected by way of post 176, 178 to a handle base 180 configured as a strip. The strip has a divided Y-shaped portion 182 which has curved portions 184, 186 to wrap around the curved top edge portion of the clear plastic shell and two downwardly extending tabs 188, 190 that fit into the recesses 136 in the horizontal top section 74 of the first molded portion 50. The horizontal top ends 189, 191 of the side handle 128 also have side engagement portions 194, 196 to engage with the lugs 134 also positioned on the horizontal top section 74. The lower end 200 of the side handle 128 has a receiving slot 202 for the tab 138 on the lower base portion 76 of the first molded portion 50. The lower end 200 also has a slot 208 to engage and secure the projection 176 on the vertical side panel 156 of the clear plastic shell.

The side handle 128 is formed of a rigid yet resiliently flexible plastic material such that the handle is strongly biased in the shape shown in FIG. 10. This allows the handle to essentially be snapped into place and to remain fixed on the sides 32, 36 and top 38 of the carrier, to engage both the first molded portion So and the second molded portion 52, and to steadfastly hold the assembly together.

Figure 12:
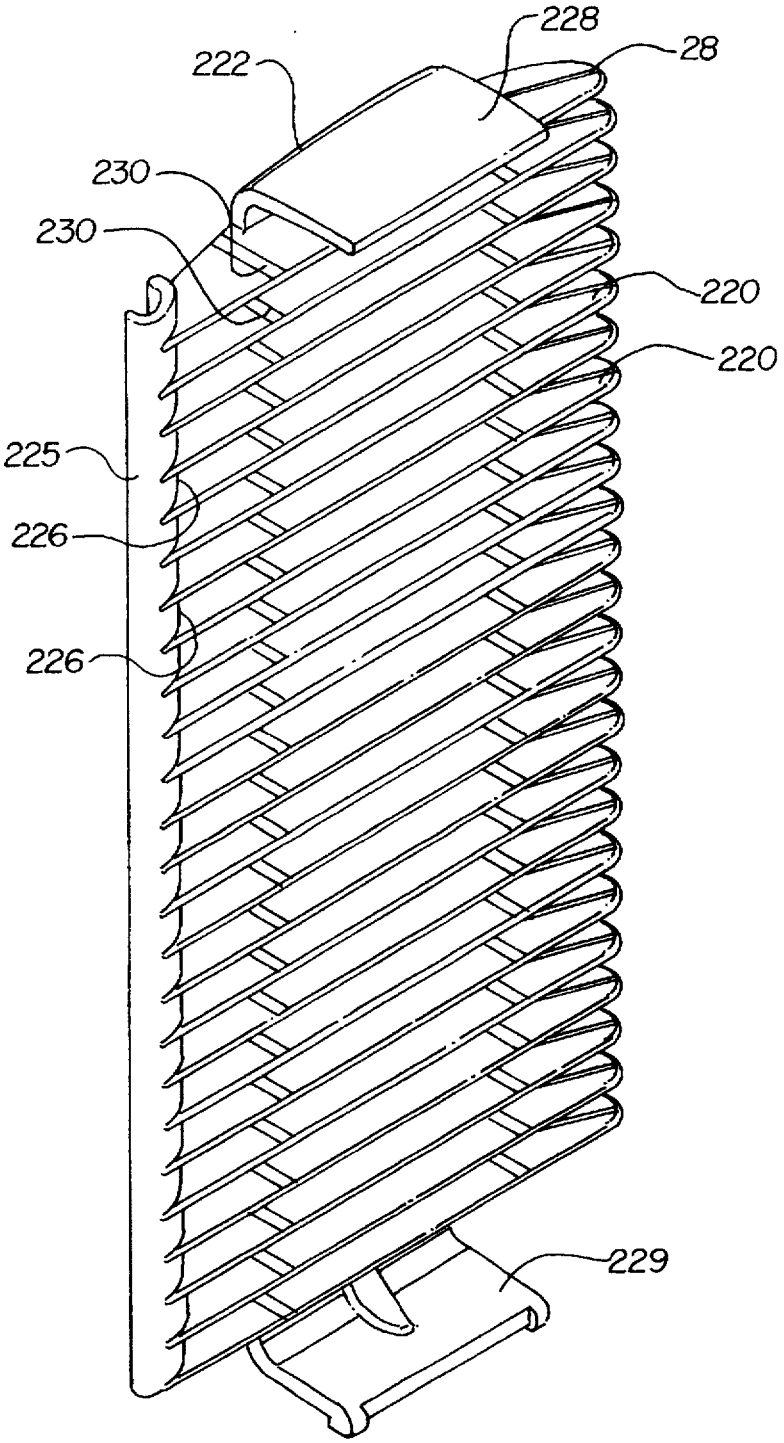
FIG. 12 is a perspective view of a wafer support column for a wafer container.
Figure 13:
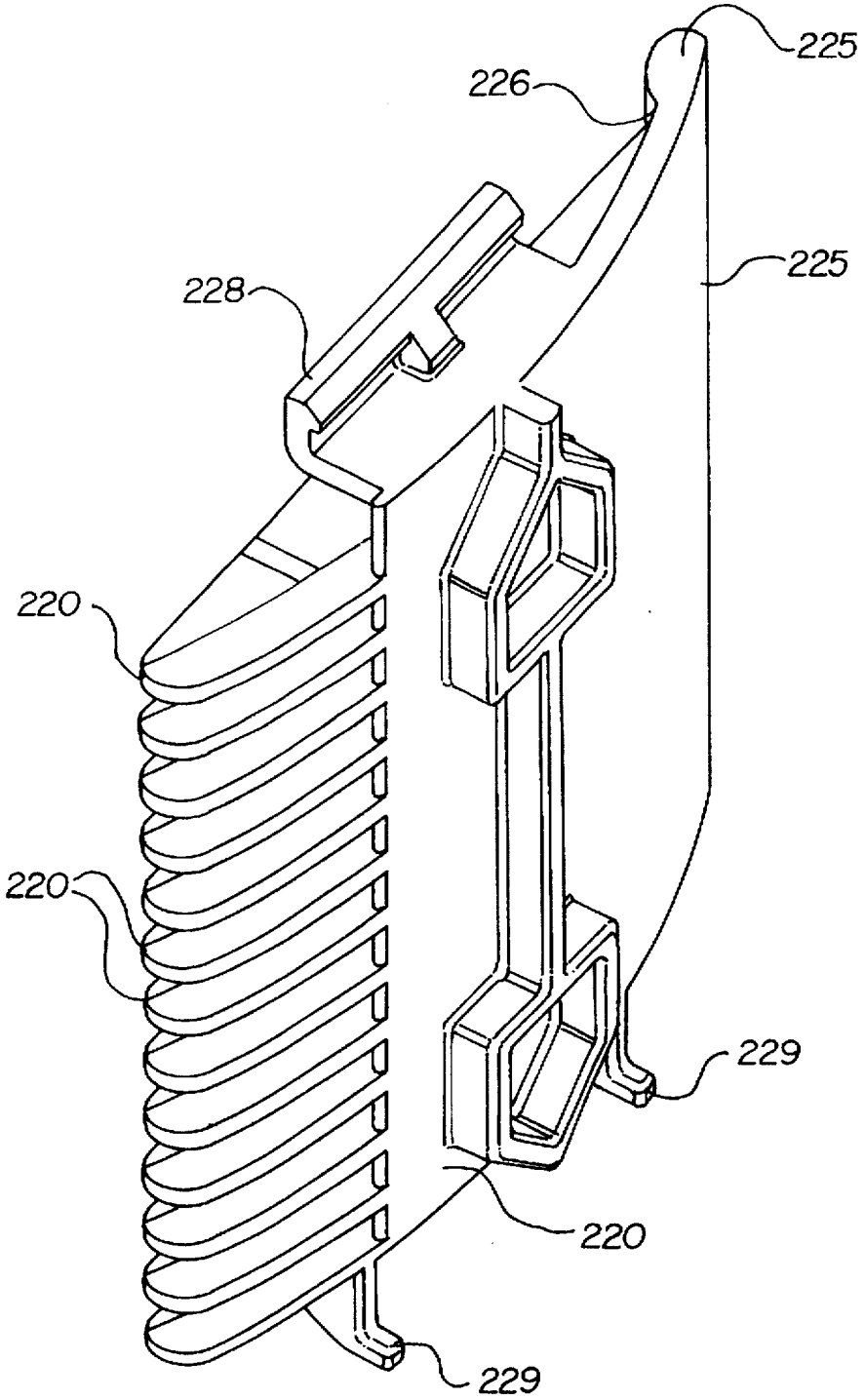
FIG. 13 is a perspective view of a wafer support column for the carrier of FIG. 5.
Figure 14:
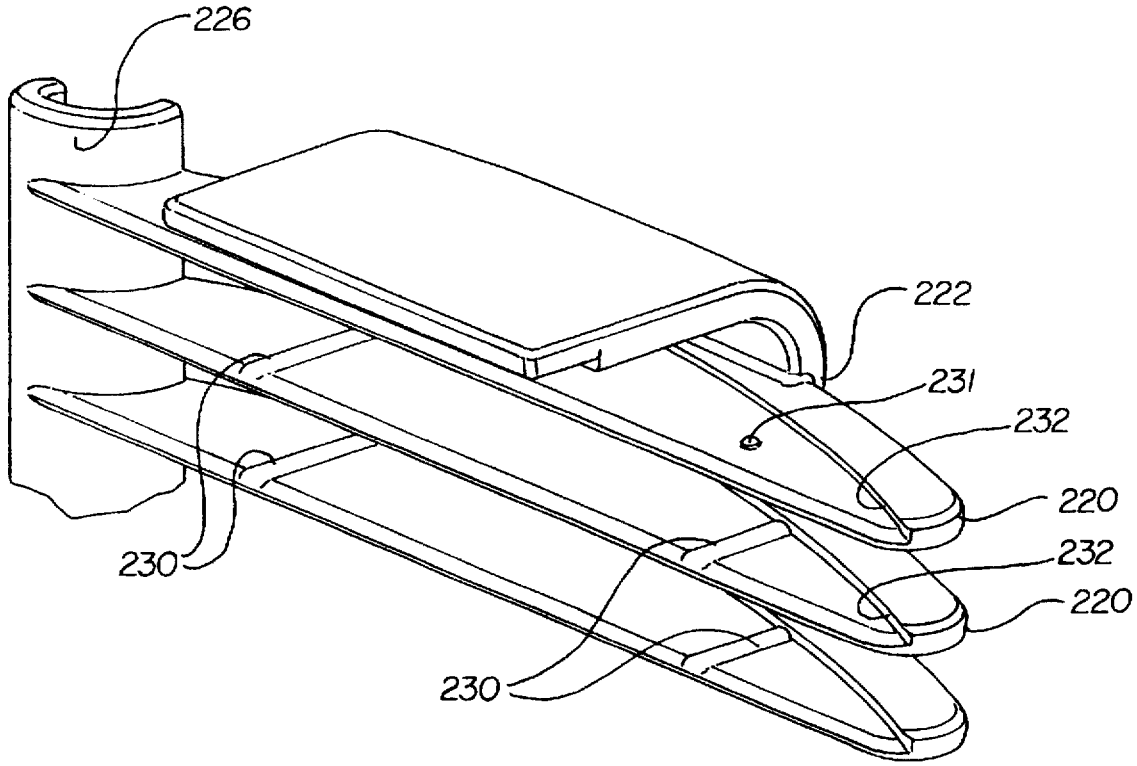
FIG. 14 is a detail perspective view of a portion of a wafer support column.

Referring to FIGS. 12, 13, 14, 15, and 16 wafer support columns 27 are shown in two principle configurations. FIG. 13 is a wafer support column suitable for the open carrier shown in FIG. 5. FIGS. 12 and 14 show a configuration of wafer support columns 27 suitable for use in the carrier embodiment of FIG. 1 and FIG. 4. Both wafer support columns 27 attach into their respective carrier by way of tabs 138 or lugs 134. Alternate mechanical fastening means may also be utilized. Referring particularly to FIGS. 12, 13, and 14, the wafer support column 27 is comprised of a plurality of shelves 220 which connect to a vertical support member 222 and a rear post 225 with rear stops 226. Upper and lower tongue portions or lugs 228, 229 extend from the vertical support member 222 and are secured with the corresponding recesses or slotted members 106, 108, 110, 112. An alternative configuration of wafer support columns 27 is shown in FIGS. 2 and 3. These wafer support columns 27 are shown with direct attachment to the U-shaped panel 150 such as by screws 231. The wafer support columns of FIGS. 2 and 3 each have a plurality of individual wafer supports or shelves 220, each shelf having a single wafer engagement projection 230 configured as an elongate bead. Note that wafer support columns may, in some embodiments of the invention, be integral with the container portion and still provide many of the advantages and features identified above.

Referring to FIGS. 6, 14, 15, and 16, further details and positioning of the wafer support columns 27 and shelves are shown. Each shelf 236 has a corresponding opposite shelf 238 on the opposite side of the carrier. The opposing wafer support columns 27 with the opposing shelves are positioned on a center line through the wafer parallel to the open front 30 and door frame 56 and perpendicular to the direction 229 of insertion and removal of the wafers W. To support for the wafers, each of the opposing shelves are spaced less than a wafer diameter D apart. Each wafer guide 120 has an opposite wafer guide on the opposite side of the container.

Figure 15:
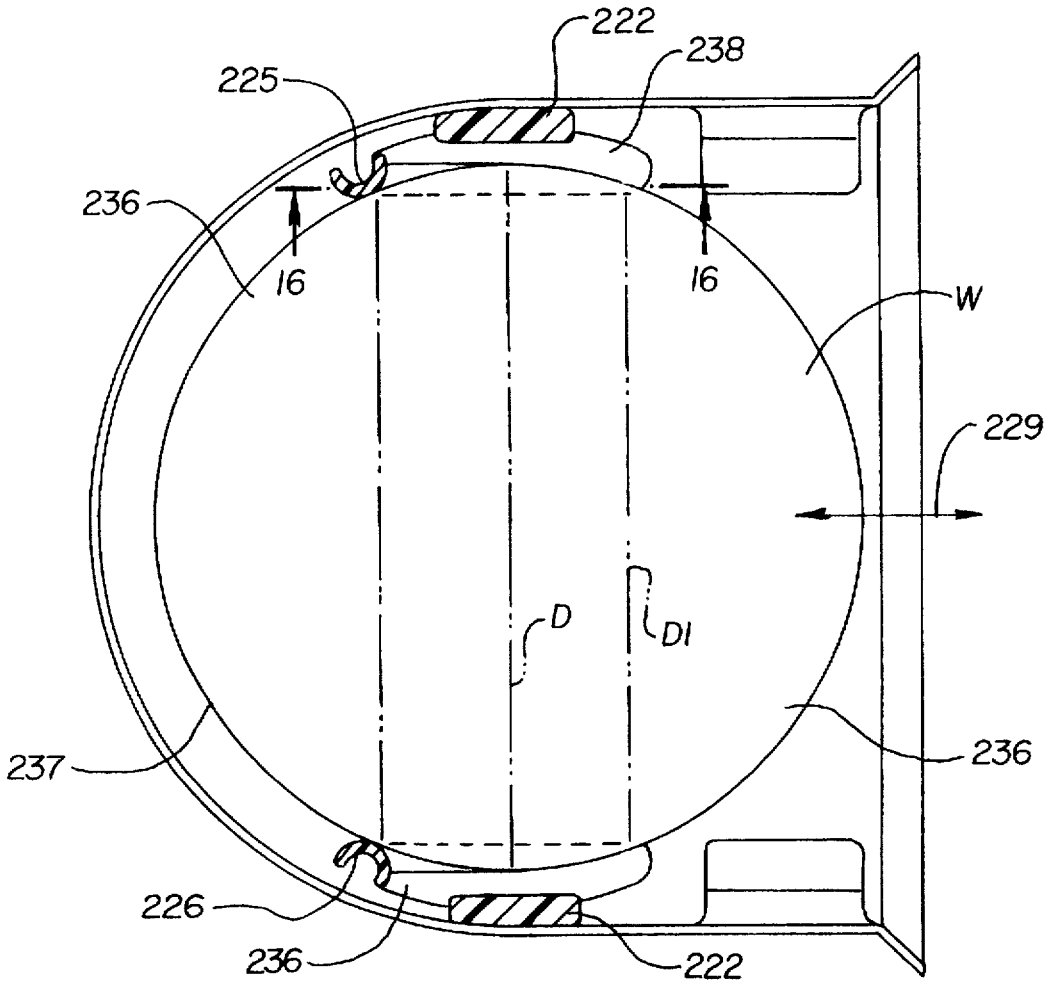
FIG. 15 is a cross-sectional plan view of a wafer carrier.
Figure 16:
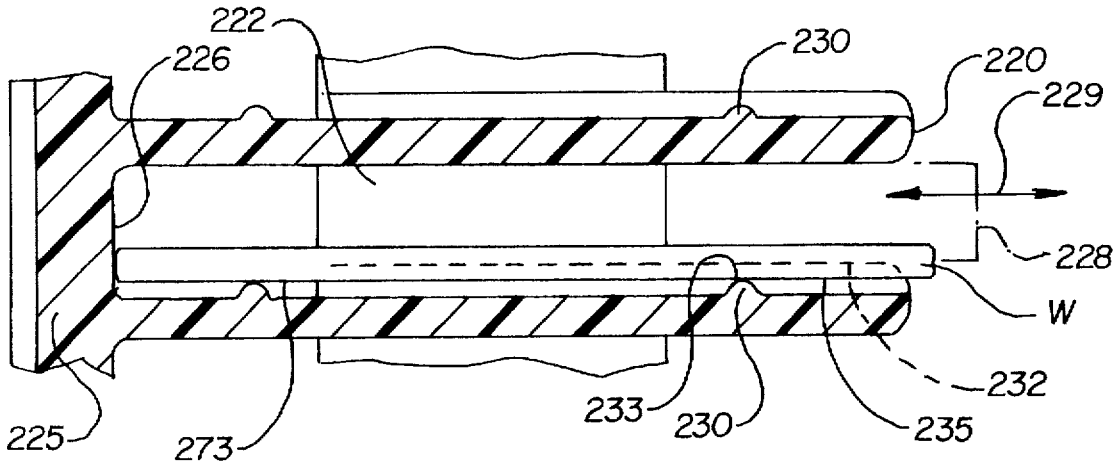
FIG. 16 is a cross-sectional view taken at line 16—16 of FIG. 15.
Figure 17:
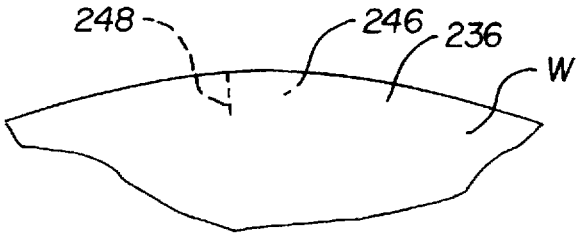
FIG. 17 is a plan view of an edge portion of a wafer illustrating he minimal point wafer contact and support.

Referring to FIGS. 6, 15, and 16, the space between each vertically adjacent pair of wafer guides and the distance across the interior of the carrier defines a wafer insertion and removal level and a wafer slot 244. Similarly, an insertion level and is defined by the area between vertically adjacent wafer support shelves 220. The wafer slot is further defined as the area across the carrier between the vertical support members of the wafer support column. Each shelf has a pair of upward facing wafer engagement projections 230 configured as beads. A bead may be a nub shaped generally as a partial sphere, as shown in FIG. 14 as element number 231, or a partial cylindrical rod with smooth ends element number 230. Referring to FIG. 17, such provide minimal point contact 246 or minimal abbreviated substantially radially oriented line contact 248 at the apex 233 of the projection apex contacts the underside or lower surface 235 of the wafer W at the edge portion 236. The elongate beads, as shown, extend substantially radially inward. Each wafer shelf 220 has a forward, that is, toward the front, wafer stop 232 configured as a vertical contact surface that follows the circumferential shape of the wafer W when the wafer is in the wafer seating position as shown in FIG. 15. The forward wafer stop 232 does not extend into the wafer insertion and removal level but does interfere with movement outwardly of wafers seated in the wafer seating position. The distance Dl between the corresponding forward wafer stops of each opposing wafer support shelf is less than the diameter D of the wafer W.

Each support shelf has a rear wafer stop 226 as part of the rear post 225. The rear wafer stop extends upwardly to define the rear limits of the wafer slot. The distance D2-between the corresponding rear wafer stops 226 of each opposing wafer shelf is less than the wafer diameter D. The rear wafer stops 226 extend into the vertical elevation of the wafer slot. The rear wafer stop 226 can also serve to guide the wafer upon insertion into the wafer seating position 237 as shown best in FIGS. 15 and 16.

The above identified components which are shown as part of the first molded portion 50 may be unitarily molded and are thus integral with each of said other parts. Similarly the second molded portion 52 configured as the clear plastic shell is unitarily molded. The wafer support columns 27 will be formed of a static dissipative, high abrasion resistant material. The side handles and robotic flange will also be molded of static dissipative material. With the first molded portion 50 also formed of a static dissipative material, a conductive path to ground is provided for the robotic flange, the side handles, and the wafer shelves 220 and wafer support columns 27 through the equipment interface which is part of the first molded portion 50 and which engages a grounded interface on the equipment. Note that the equipment interface may be three sphere-three groove kinematic coupling as illustrated or a convention H-bar interface or other suitable interfaces. As an alternative to directly connecting each of the parts formed of static dissipative material as shown in FIGS. 1, 4, and 5 the parts may be conductively connected such as by conductive plastic jumpers 241 suitably connected to the parts as shown in FIG. 3.

Generally a carrier or component is considered to be static dissipative with a surface resistivity in the range of $10^5$ to $10^{12}$ ohms per square. For a material to provide a conductive path such as to ground resistances less than this may be appropriate.

Significantly, the molding parameters and material selection may be made for each separately molded part to optimize performance and minimize cost.

The present invention may be embodied in other specific forms without departing from the spirit or essential attributes thereof, and it is therefore desired that the present embodiment be considered in all respects as illustrative and not restrictive, reference being made to the appended claims rather than to the foregoing description to indicate the scope of the invention.

I claim:

1. A water container comprising a container portion comprising:

a generally rectangular upright frame, the frame having a horizontal top frame member, a lower frame member parallel to the top frame member, a pair of opposite and upright side frame members extending between and integral with the lower frame member and the top frame member, said frame members defining the open front for receiving wafers;

a substantially horizontal top section integral with and extending rearwardly from the top frame member;

a substantially horizontal lower base portion integral with and extending rearwardly from the lower frame member; and a second molded portion comprising a transparent plastic shell, the shell connecting to the top panel portion, connecting to the lower base portion, and having a U-shaped section extending therebetween.

2. The wafer container of claim 1 further comprising a plurality of wafer support columns extending between the top portion and the lower base portion, the wafer support columns comprised of a plurality of vertically arranged wafer contact shelves, the wafer contact shelves of each column aligned and spaced to define a plurality of vertically aligned substantially horizontal and parallel wafer slots.

3. The wafer container of claim 2 wherein each column of wafer support shelves are separately formed and wherein each wafer support column is molded of static dissipative material.

4. The container of claim 2, wherein the rectangular frame, the top portion, the base portion, and the wafer support columns, are all formed of static dissipative material are conductively connected and the transparent material is formed of non-static dissipative material.

5. The container of claim 1, wherein the wafer container is adapted to interface with related equipment, the related equipment having an interface portion and wherein the lower base portion of the wafer container further comprises an equipment interface configured to engage with the interface portion of the related equipment.

6. The container of claim 2, further comprising a pair of opposite and inwardly projecting vertical rows of wafer guides, each of the guides spaced vertically and arranged to correspond to each of the plurality of slots, each slot corresponding to a different wafer shelf, the rows of wafer guides respectively positioned on each of the upright side frame members.

7. The container of claim 6, wherein each wafer contact shelf of each wafer support column comprises an upwardly extending bead for contacting and supporting each wafer.

8. The container of claim 5, wherein the wafers to be contained by the wafer container have a circumferential edge, wherein each wafer slot has a wafer seating position, and wherein the wafer container has a plurality of wafer stops, each stop positioned rearwardly of the upwardly extending beads, the wafer stop configured and positioned to contact the wafers during insertion of said wafers when said wafers are urged horizontally beyond the wafer seating position.

9. The container of claim 2, wherein each wafer contact shelf on each support column comprises a forwardly positioned upwardly facing bead and a rearwardly positioned upwardly extending bead for contacting and supporting a wafer.

10. The container of claim 5, wherein each of said contact beads is elongate, is oriented substantially radially inward, and has a length of less than 6 millimeters.

11. The container of claim 3, wherein the base portion has a bottom surface and includes an equipment interface, the first molded portion is formed of static dissipative material, wherein the container further provides a robotic flange formed of static dissipative material and wherein the robotic flange, the wafer support columns and the door frame have a conductive path to the equipment interface.

12. The container of claim 1, further comprising a pair of handles connecting to the first molded portion and the second molded portion securing said portions together.

13. A wafer carrier for holding wafers in a horizontal and axially aligned array, the carrier having a front with a door, a closed top, a closed bottom, a closed backside, a closed left side, and a closed right side, the carrier comprising:

an upper portion extending substantially horizontally from the front rearwardly over the wafers, a substantially horizontal lower portion extending from the front rearwardly under the wafers, a vertical left side member positioned at the front and a vertical right side member positioned at the front, the upper portion, the lower portion, the vertical right side member, and the vertical left side member all integrally molded of static dissipative plastic;

a plurality of vertically aligned wafer supports at the left side of the container and a plurality of corresponding vertically aligned wafer supports at the right side of the container for supporting wafers substantially horizontally in an axially aligned arrangement; and a clear plastic shell that extends from the vertical left side member around the left side, around the back side, and around the right side to the vertical right side member, the plastic shell joined to the top portion and to the bottom portion.

14. The wafer carrier of claim 13 wherein the wafer supports comprise a pair of oppositely positioned support columns, one on each side of the carrier, each support column extending from the upper portion to the lower portion, the support columns conductively connected to the upper portion and the lower portion, the support columns each having a plurality of vertically arranged upwardly extending projections for substantially point contact at each protrusion with the underside of the wafers.

15. A wafer carrier for holding wafers in a substantially horizontal arrangement, the wafers having a lower surface the carrier having an open front, a backside, a top portion, a bottom portion, a left side and a right side, the carrier further comprising:

a pair of wafer support columns extending from the top portion to the bottom portion, one support column located at the right side and one located at the left side, each wafer support column comprised of a plurality of vertically arranged shelves, each shelf comprised of at least two upwardly extending beads for minimal contact with the lower surface of a wafer at each bead, each shelf further having an insertion level and a seating level for a wafer, whereby a wafer may be inserted into the carrier through the open front at an insertion level and lowered to sit on the upwardly extending beads at the seating level.

16. The wafer carrier of claim 15, wherein each shelf is further comprised of a forward stop positioned at the seating level at least partially forward and inwardly of the upwardly extending beads thereby interfering with the forward movement of a wafer seated in said shelf, each shelf further having rearward stops positioned rearwardly and inwardly of the upwardly extending beads thereby interfering with the rearward movement of a wafer in said shelf, said forward stops not extending into the insertion level whereby the wafers may be inserted and removed at the insertion level without interference with said forward stops.

17. The wafer carrier of claim 15 further comprising an integrally molded outer transparent shell extending around and enclosing the left side, the backside and the right side.

18. The wafer carrier of claim 15 wherein the top portions, bottom portion and the wafer support columns are separately molded of static dissipative material and are mechanically connected.

19. The wafer carrier of claim 18 wherein the wafer contact beads are elongate and are oriented inwardly.

20. The wafer carrier of claim 19 wherein each column of wafer support shelves are formed separately from the outer shell and wherein the columns are attached to the outer shell.

21. The wafer carrier of claim 15 further comprising an integrally molded outer shell comprised of the top portion and the bottom portion and extending around enclosing the left side, the backside and the right side.

22. The wafer carrier of claim 21 wherein each column of shelves is separately formed from the outer shell and each column is formed of a static dissipative material, wherein the carrier further comprises a bottom base portion having an equipment interface, said bottom base portion separately formed from the outer shell and formed of a static dissipative material, wherein each column of shelves and the bottom base are conductively connected.

23. The wafer carrier of claim 22 wherein the wafers each having a seating position on the respective shelves such that the seating position is below the insertion level.

24. A composite wafer container adapted to engage a grounded interface on processing equipment, the container having an open interior, a front, a back, a left side, a right side, a top and a bottom, the container comprising a rectangular door frame defining an opening for entry and removal of wafers from the container;

a transparent plastic non static dissipative shell having a U-shape, the shell connected to the door frame;

at least two wafer support columns facing the interior of the container, the support columns attached at the sides of the container and formed of static dissipative material;

an equipment interface located on the bottom of the container, the interface configured for engaging the processing equipment, the equipment interface formed of static dissipative material; and the wafer support columns conductively connected to the equipment interface.

25. The carrier of claim 24 further comprising a robotic pickup handle located on the equipment for facilitating robotic pickup, the robotic pickup formed of static dissipative material and conductively connected to the equipment interface, the door frame, the wafer support structures, the equipment interface, are conductively connected whereby a path to ground is provided for said door frame, said wafer support structures, and said robotic pickup handle.

26. The carrier of claim 24 wherein the door frame is formed of static dissipative material and is conductively connected to the equipment interface.

27. The carrier of claim 24 further comprising a pair of handles attached to the left side and right side respectively, the handles formed of static dissipative material and conductively connected to the equipment interface.

28. The carrier of claim 25 wherein the equipment interface, the wafer support structures, the pickup handles are conductively connected in part by conductive plastic jumpers.

29. A composite container having a front, a top, a bottom, a left side, a right side and a backside, the container comprising a outer clear plastic shell extending around the left side, the back side, the right side, and the top, a pair of interior wafer support structures each facing the interior of said container, the wafer support structures formed of a static dissipative material, an equipment interface portion formed of a static dissipative material positioned at the bottom of said container for interfacing with processing equipment, the equipment interface portion joined to the clear plastic shell and formed of a static dissipative material, a pickup handle attached to said transparent plastic shell, said pickup handle formed of static dissipative material, the equipment interface, the wafer support structures, the pickup handle conductively connected together.

30. A wafer carrier for holding wafers substantially horizontally in a vertically stacked arrangement, the wafers having a lower surface, the carrier having an open front for insertion and removal of wafers, a backside, a top portion, a bottom portion, a left side and a right side, each of the left and right sides comprising a plurality of vertically arranged shelves, each shelf comprised of at least two upwardly extending beads for minimal contact with the lower surface of a wafer at each bead, each shelf further having an insertion level and a seating level for a wafer, whereby a wafer may be inserted into the carrier through the open front at an insertion level and lowered to sit on the upwardly extending beads at the seating level.

31. The wafer carrier of claim 30, wherein the backside is open and wherein the bottom portion comprises an equipment interface.

* * * * *